US005466346A

United States Patent [19]

Chou et al

[11] Patent Number: 5,466,346

[45] Date of Patent: Nov. 14, 1995

[54] QUINONE SYNTHESIZED FROM AN AROMATIC COMPOUND IN AN UNDIVIDED ELECTROCHEMICAL CELL

[75] Inventors: Tse-Chuan Chou; An-Cheng Lee, both of Tainan, Taiwan

[73] Assignee: National Science Council, Taipei, Taiwan

[21] Appl. No.: 236,639

[22] Filed: May 2, 1994

[51] Int. Cl.[6] ..... C25B 3/00; C25B 3/02

[52] U.S. Cl. ..... 204/72; 204/78

[58] Field of Search ..... 204/59 R, 72, 204/78

[56] References Cited

U.S. PATENT DOCUMENTS 4,950,368 8/1990 Weinberg et al. ..... 204/72

FOREIGN PATENT DOCUMENTS 147741 11/1981 Japan .

OTHER PUBLICATIONS

Lee et al., "Mechanism and factors affected on the paired Electro–oxidation of anthracene to anthraquinone", Chem. Eng. Comm., vol. 123 (1993), pp. 179–193 (no month).

Hsiao et al., "Hydroxylation of chlorberzene and phenol in a packed bed blow reactor with electrogenerated Fenton's reagent", J. of Applied Electrochem., vol. 23 (1993 Sep.), pp. 943–946).

Jiin–Jian Jow, An–Chen Lee and Tse–Chuan Chou, "Paired electro–oxidation. I. Production of Benzaldehyde", Journal of Applied Electrochemistry 17 (1987) 753. (no month).

An–Cheng Lee and Tse–Chuan Chou, "Mechanism and Factors Affected on the Paired Electro–Oxidation of Anthrancene to Anthraquinone", Chem. Eng. Comm. 1993, vol. 123, pp. 179–193. (no month).

*Primary Examiner*—John Niebling
*Assistant Examiner*—Edna Wong
*Attorney, Agent, or Firm*—Hitt Chwang & Gaines

[57] ABSTRACT

A method for synthesizing quinone from an aromatic compound is developed that employs a paired electro-oxidation method and a undivided electrochemical cell. The electrolyte solution is a combination of an aromatic solution (aqueous or nonaqueous) and a redox mediator solution, which can be $V^{5+}/V^{4+}$, $Fe^{3+}/Fe^{2+}$, or $Cu^{2+}/Cu^{+}$, in an undivided electrochemical cell. The electrolyte reaction is conducted by bubbling oxygen into the bottom of the cathode, then the oxygen is reduced to hydrogen peroxide ($H_2O_2$). Simultaneously, at the anode surface, lower valence state ions can be oxidized to higher valence states. Hydrogen peroxide then oxidizes the rest of the low valence state ions to form high valence ions, OH-free radicals, and combinations of both. These ions and radicals then react with the aromatic compound in the solution and form the resultant product, quinone.

20 Claims, 2 Drawing Sheets

QUINONE SYNTHESIZED FROM AN AROMATIC COMPOUND IN AN UNDIVIDED ELECTROCHEMICAL CELL

BACKGROUND

This invention pertains to an effective method to electrochemically synthesize quinone compounds from aromatic compounds using a paired electro-oxidation approach in an undivided cell.

The two primary techniques for oxidizing an aromatic compound to a quinone compound are: (1) the catalytical oxidation method; and (2) the electro-oxidation method. The first method requires high temperature, high pressure, and catalysts. Maintaining this high temperature and pressure results in high cost, difficulty of operation, and poor selectivity of resultant products.

Using an electrochemical method to convert an aromatic compound to a quinone compound has several advantages including low temperature and pressure, easy to operate, and high selectivity of resultant products.

The electro-oxidation approach is to oxidize an aromatic solid or its organic solution in an anode of an electrochemical cell to produce a quinone. The electrolyte solution is composed of a redox mediator solution and an aromatic compound (solid or solution). The redox mediator solution can be an aqueous inorganic redox couple in solution such as $Mn^{3+}/Mn^{2+}$, $Ag^{2+}/Ag^{+}$, $Ce^{4+}/Ce^{3+}$ $V^{5+}/V^{4+}$, $Co^{3+}/Co^{2+}$, and $Tl^{3+}/Tl^{2+}$. The low valence state metal ions of the redox mediator are oxidized first on the anode surface and become higher valence ions. Then the oxidized ions react with the aromatic compounds and form quinone and lower valence ions. The resultant product, i.e., the quinone compound, can be removed from the solution, and simultaneously the lower valence ions can be recycled into the cell for another oxidation cycle. The cycle can proceed continuously until the aromatic compound is completely exhausted.

Among the chemical reactions, quinone is formed on the anode surface, and the cathodic reaction involves a fine metal wire (as cathode) and the reduction reaction of water, which forms hydrogen; or alternatively, to reduce some undesired compound so that the reaction on the anode surface would not be affected. Consequently, the process becomes inefficient, resulting in a poor distribution of the system voltage and current, and the waste of electric energy on the cathode.

U.S. Pat. No. 4,950,368 provided a paired electro-oxidation method to synthesize ethylene glycol on the cathode from the reduction of formaldehyde in an electrochemical cell that had a dialysis membrane installed in the middle. Simultaneously, at the surface of the anode, higher valence metal ions are formed. These ions can oxidize another compound and produce a second product. This paired electro-oxidation approach can increase efficiency and save energy; however, there are still disadvantages. For example, the resultant products of both electrodes are not the same, requiring further separation.

In the R.O.C. Patent No. 30226 (application No. 76100506), equivalent to *J. of Applied Electrochemistry* 17 (1987) 753–759, the detailed procedure of a paired electro-oxidation synthesis method for the production of aromatic aldehyde is described. The method, which generated a Fenton's reagent, could be used to oxidize toluene to benzaldehyde. Simultaneously, at the anode the $Mn^{2+}$ was oxidized to $Mn^{3+}$, and $Mn^{3+}$ could continuously oxidize toluene to benzaldehyde. The $Mn^{2+}$ ions were reoxidized at the anode again and could be used repeatedly.

The purpose of this invention is to develop a paired electro-oxidation method to synthesize a quinone compound effectively from an aromatic compound. An improved reactor design for the paired electro-oxidation reactions is employed, i.e., reactions take place in an undivided single cell without the presence of any membrane.

SUMMARY

An effective paired electro-oxidation synthesis method that can oxidize an aromatic compound and form a quinone compound is provided. The electrolyte solution can be a combination of an aromatic solution (aqueous or nonaqueous) and a redox mediator solution such as $V^{5+}/V^{4+}$, $Fe^{3+}/Fe^{2+}$, or $Cu^{2+}/Cu^{+}$, in an undivided electrochemical cell. Electrolytical reaction is carried out by bubbling oxygen into the bottom of the cathode. At the anode surface of this cell, lower valence state ions can be oxidized to higher valence state; simultaneously, oxygen is reduced to hydrogen peroxide ($H_2O_2$) at the cathode surface. $H_2O_2$ then oxidizes the rest of low valence state ions and forms high valence ions, .OH free radicals, and combinations of both, which can react with the aromatic compound in the solution to form the resultant product—quinone.

In the above description, optimally, the aromatic compound is anthracene or an anthracene attached with at least one or more —$OH_3$, —$NO_2$, $C_1$–$C_8$ alkyl and halogen functional groups.

Optimally, the organic solution and the redox mediator solution is well stirred during the process.

Optimally, an anode plate in the electrochemical cell and the cathode is constructed in a parallel-metal-net cylindrical form.

Optimally, the redox mediator solution contains some supporting electrolytes, which can be $H_2SO_4$, $HClO_4$, $HNO_3$, $HNO_2$, formic acid, and acetic acid. The adequate concentration of the supporting electrolyte is from 0.5 to 10 molar.

The unique advantages of this invention are: (1) redox reactions of anode and cathode take place in an undivided electrochemical cell; (2) only one kind of redox mediator is used; (3) electrochemical reactions occur on both electrodes and indirectly convert the reactant to product, then product to reactant; (4) the undivided electrochemical cell does not need any membrane; (5) the structure is simple, cost effective, and easy to maintain.

Figure 1:
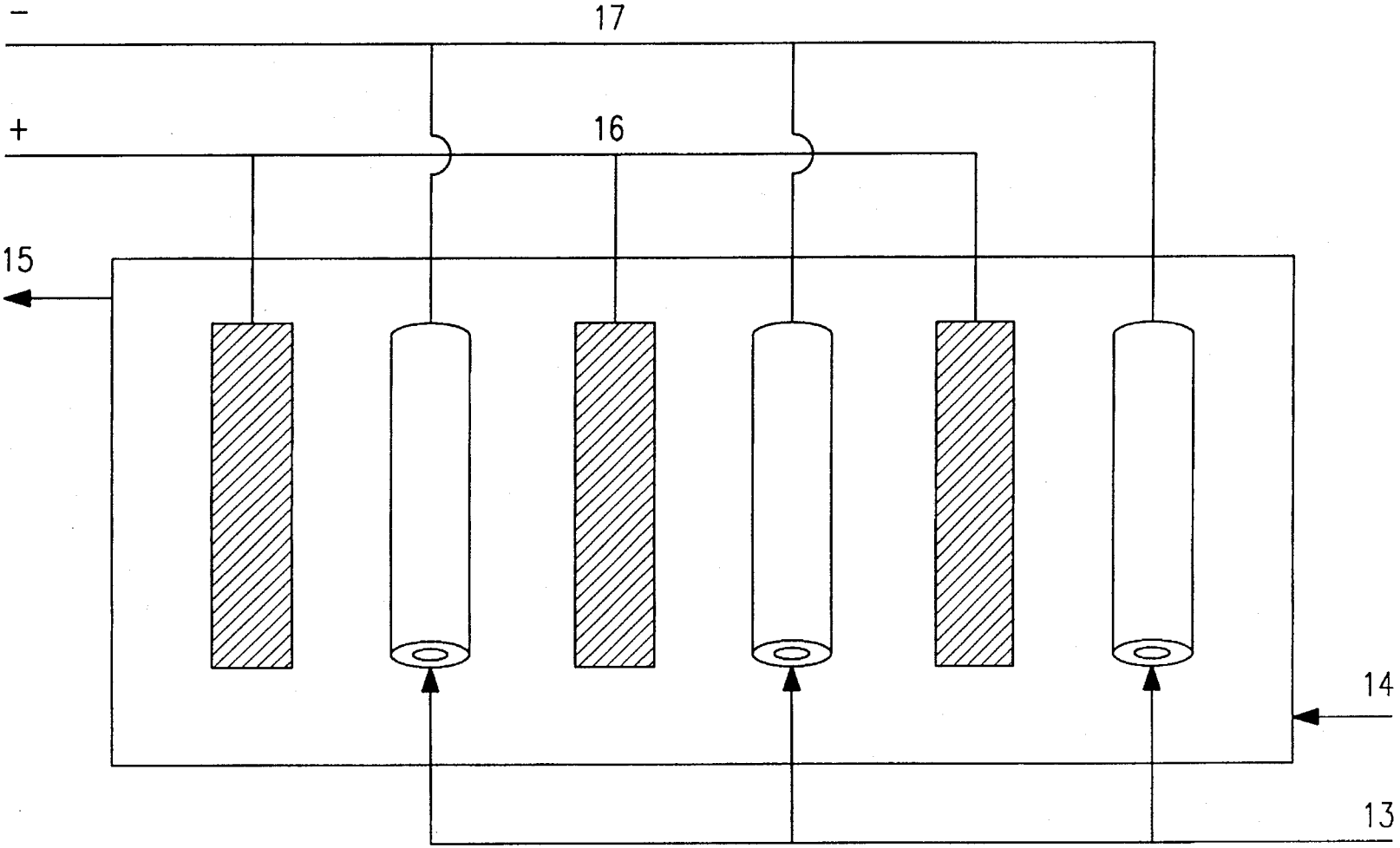
FIG. 1 shows the design of the undivided electrochemical cell.

This invention, including the rationale and the significant improvement of the cell design, can be further understood by the following description.

DETAILED DESCRIPTION

A unique method that effectively synthesizes a quinone from an aromatic compound using paired redox electrochemical reaction and an undivided cell is provided. The electrochemical cell contains a redox mediator (which can be $V^{5+}/V^{4+}$, $Fe^{3+}/Fe^{2+}$, or $Cu^{2+}/Cu^{+}$), an electrolyte solution, and the aromatic compound. Oxygen is bubbled into the solution at the bottom of the cathode. Among the chemical reactions, higher valence state metal ions oxidants are formed on the cathode surface. The lower valence state metal ions in solution form a Fenton reagent, which in turn is also a strong oxidant. Therefore, the aromatic compound in solution reacts with both strong oxidants at both electrodes and forms the desired quinone compound.

All the chemical reactions taking place in the electrochemical cell can be illustrated by the example of anthracene oxidized to anthraquinone. A mixture of anthracene and its organic electrolyte solution, a redox mediator, $V^{5+}/V^{4+}$, is well stirred in an electrochemical cell where the anodic reaction is:

$$V^{4+} \rightarrow V^{5+} + e^-$$

the cathodic reaction is:

$$2\ H^{++}O_2 + 2\ e^- \rightarrow H_2O_2$$

and the chemical reactions in the solution are:

$$H_2O_2 + V^{4+} \rightarrow .OH + V^{5++}OH^-$$

$$C_{14}H_{10} + 6\ V^{5+} + 2\ H_2O \rightarrow C_{14}H_8O_2 + 6\ V^{4+} + 6\ H^+$$

$$C_{14}H_{10} + 6\ .OH \rightarrow C_{14}H_8O_2 + 4\ H_2O$$

As the above reactions indicate, $V^{4+}$ ions are first oxidized on the anode surface and form $V^{5+}$ ions, which then release to the solution and react with anthracene to form anthraquinone. Simultaneously, $V^{5+}$ ions are reduced to $V^{4+}$ ions. Part of the $V^{4+}$ions will be reoxidized on the anode surface. Another part of the $V^{4+}$ ions react with $H_2O_2$ on the cathode to form $V^{5+}$ ions and .OH free radicals, which will continue to oxidize anthracene and generate anthraquinone.

At the cathode surface, a Fenton reagent, which contains a lower valence metal ions and $H_2O_2$, is formed. The $H_2O_2$ reacts with $V^{4+}$ ions in the solution to form .OH-free radicals and $V^{5+}$ ions, which can oxidize anthracene to anthraquinone. The Fenton reagent is a strong oxidant that can oxidize many organic compounds such as anthracene and toluene. Besides $V^{4+}$ ions, $Fe^{2+}$ ions and $Cu^+$ ions can also react with $H_2O_2$ to generate .OH free radicals.

The major reaction on the cathode is to reduce the oxygen to $H_2O_2$ so that it can react with $V^{4+}$ to form .OH-free radicals; therefore, oxygen needs to be supplied to the system.

The solution contains a redox mediator and supporting electrolyte so that it can conduct current and allow the reactions to occur. The supporting electrolyte can be any aqueous soluble compound; however, it should not interfere with the oxidation of the aromatics. Alkaline and alkaline earth groups of hydroxide, such as NaOH and KOH can react with the free radicals, and consequently lower the overall efficiency. Compounds of alkaline and halogen groups are not good supporting electrolytes for this system, because a high operating voltage may result in their decomposition. That is, the halogen ions can be oxidized to elemental halogen (gas form), causing poor conductivity and product contamination. Many electrolytes, such as $H_2SO_4$, $HClO_4$, $HNO_3$, $HNO_2$, formic acid, and acetic acid, are good candidates for this system. These supporting electrolytes can perform in a wide range of concentrations; therefore, an optimal condition can be achieved. One of the most effective concentrations in the illustrated example is a 4- to 10-M sulfuric acid solution.

The material of the single undivided electrochemical cell is carefully selected so that it does not participate in the overall reaction. A good anodic material needs to have high oxygen overpotential, and some metal oxides such as PtO, PbO, and SbO are good representative materials. These materials can be coated on graphite, titanium, or ceramic materials. A good cathodic material needs to have a good catalytic property to enhance the reaction, i.e., to facilitate the reduction from oxygen to hydrogen peroxide. Good representative materials for the cathodic materials are platinum, mercury, and lead. These materials can be solid or just a coating on the supporting cathode surface. Common metals such as iron, aluminum, and zinc are inadequate for the design of this invention due to their high reactivities that may participate electrochemical reactions. Very often these inorganic ions can form various salts or even hydrogen; therefore, they may have an adverse effect on the formation of many aromatics.

The shape of both electrodes can be a flat surface, a net-like constructed, or a matrix form. Optimally, larger surface area at the cathode will enhance the reactions, i.e., more oxygen will be reduced to hydrogen peroxide. In one of the examples of this invention, a parallel-platinum-net cylindrical cathode with a sponge-like surface has been proven to be very effective.

The operating temperature of this invention is between 10° and 55° C. The operating pressure is the same as the atmosphere or close to 1 atm. The preferred operating conditions are 10° to 35° C. and 1 atm.

FIG. 1 illustrates this invention including an undivided cell, a flat anode surface, and a unique parallel-platinum-net cylindrical cathode with a sponge-like surface. Both electrodes are connected by a bus bar (16 and 17). Electricity is supplied through the bus bar to both electrodes. During the real-time operation, a solution that contains $V^{4+}$, $H_2SO_4$, and an anthracene dissolved in chloroform ($CHCl_3$) is fed into the cell from line (14). Oxygen is bubbled into the cell through a gas dispenser (13, not shown in the Figure) and many small oxygen bubbles are formed. These oxygen bubbles transport to the bottom of the cathode, penetrate the parallel-metal-net cylinder, are reduced to hydrogen peroxide, then diffuse into the bulk solution and react with $V^{4+}$ ions. The products, $V^{5+}$ ions and the .OH-free radicals, can oxidize anthracene to anthraquinone. Simultaneously, $V^{4+}$ ions are oxidized to $V^{5+}$ ions on the anode surface, and released into the solution, to oxidize anthracene to anthraquinone. An agitation device (does not show in the Figure) is also installed to enhance the contact between aqueous and organic phases.

After various electrochemical reactions, the bulk solution is taken out through a pipeline (15), then the aqueous and organic phases are separated and the aqueous phase will be recycled to the cell. The organic phase contains chloroform, anthracene, and anthraquinone. Anthraquinone can be removed and the remaining anthracene is refluxed and fed into the electrochemical cell.

Figure 2:
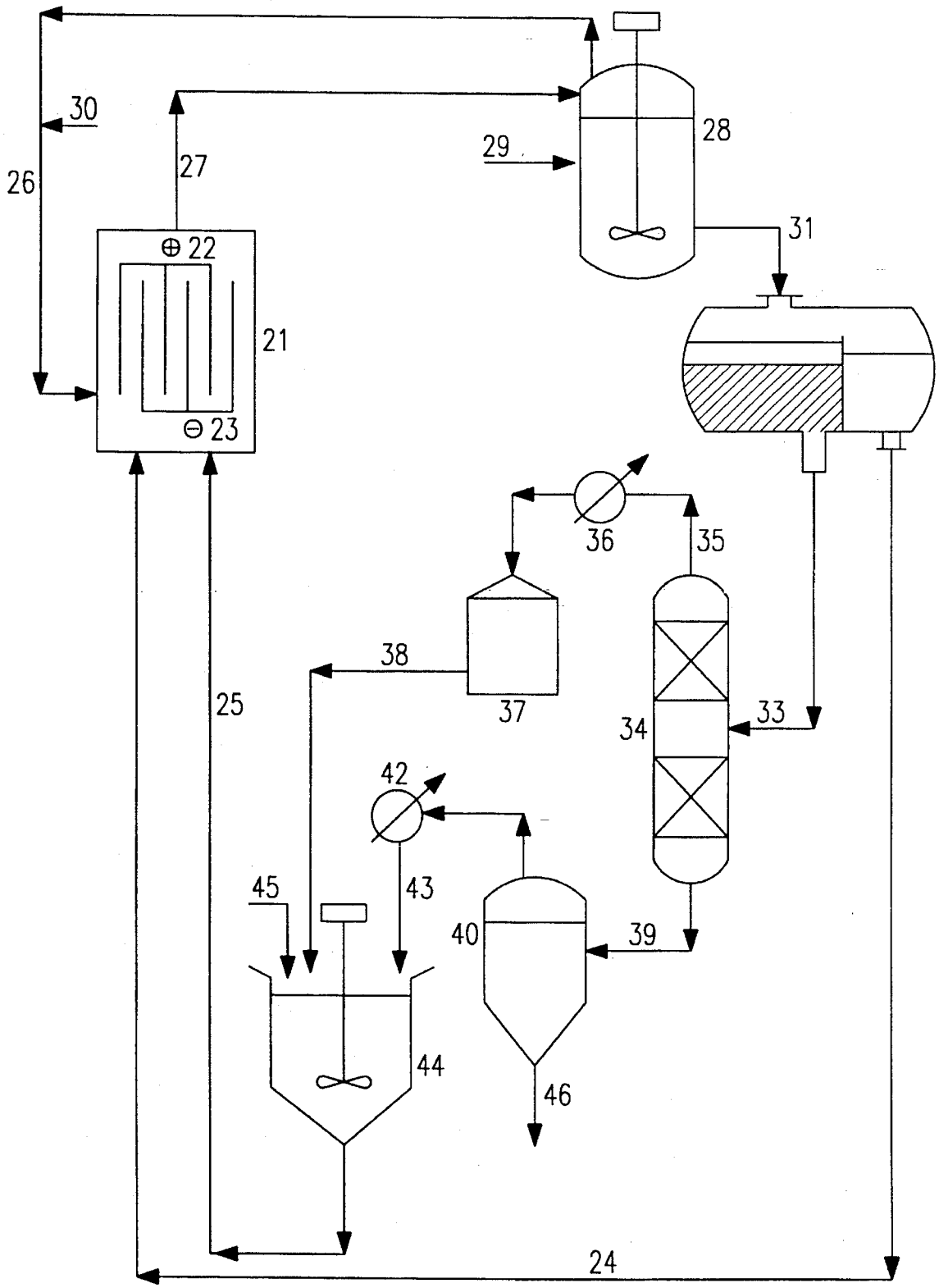
FIG. 2 shows a flow scheme of the continuous process for the production of anthraquinone using this invention.

FIG. 2 illustrates the continuous process for the production of anthraquinone from anthracene. The reactor design of the undivided electrochemical cell, as illustrated in FIG. 1, is used in this invention. In the undivided cell (21), a mixture containing $H_2SO_4$, $CHCl_3$, and anthracene is introduced into the electrochemical cell through (24) and (25). Some $V^{4+}$ ions are oxidized on the anode to form $V^{5+}$ ions. The oxygen is bubbled into the cathode (23) through pipeline (26), diffused through the parallel-metal-net cylindrical electrode, and reduced to hydrogen peroxide. The $V^{4+}$ ions in the bulk solution react with the hydrogen-peroxide-generated $V^{5+}$ ions and .OH—free radicals. The $V^{5+}$ions that generate from both electrodes together with .OH—free radicals electrochemically convert the anthracene to anthraquinone. The solution after electrolysis and chemical reactions is guided out of the cell through (27) to a second reactor (28). In this second reactor, additional $H_2O_2$ is merged into this reactor through pipeline (29), and reacted with $V^{4+}$ ions, to form $V^{5+}$ ions and .OH—free radicals. Both $V^{5+}$ ions and .OH—free radicals can oxidize anthracene to anthraquinone. After the reactions, the solution of the second reactor is transported to a gravity settling tank, where both the organic and aqueous phases can be separated.

The upper phase, i.e., the aqueous phase, will be recycled to the electrochemical cell through line (24), whereas the lower phase, i.e., the organic phase, will be fed into a distillation tower (34) through line (33) in order to recover the organic solvent. The vapor phase of the distillation tower passes through a condenser (36) and becomes a liquid phase, which is collected in the storage tank (37). The residue of the distillation tower is transported to a crystallization tank where the anthraquinone (which has the higher melting point) is separated from the organic phase and taken out continuously through line (46). The unreacted anthracene solution is quenched from a cooling device (42) through line, and is then transported to the starting material storage tank (44) by line (43). The fresh solvent is pumped from the solvent storage tank (37) through line (38) into the starting material tank. Anthracene is introduced into the starting material tank where it is dissolved by the organic solvent to form a saturated organic solution. The organic solution is fed into the electrolysis cell (21) through line (25).

The purpose of the following examples is to demonstrate the feasibility of this invention. The examples are not to limit or to narrow the use of this invention.

EXAMPLE 1

FIG. 1 illustrates the electrochemical synthesis of anthraquinone from anthracene. The undivided electrochemical cell has a platinum plate as the anode. A parallel-titanium-net cathodic cylinder is coated by lead and has a sponge-like shape. The surface areas of each cathode and anode are 110 and 20 $cm^2$, respectively. During the reactions, the electrolyte is guided through a fluorometer and flow upward and fed into the cell at the lower righthand corner, and later flows out of the cell from the upper left corner. The electrolyte solution contains $5.00\times10^{-3}$M of $V_2O_5$, 10M of $H_2SO_4$, and $1.12\times10^{-1}$M anthracene dissolved in $CHCl_3$. Temperature is controlled at 25±0.5° C. The oxygen is bubbled into the solution at the bottom of the cathode at a flow rate of 100 ml/min. After the reaction proceeds is identified, the electrolyte is pumped into a reactor where it is merged with a 3% $H_2O_2$ flow at a flow rate of 10 ml/min at constant room temperature and atmosphere. The organic solution samples are taken out and analyzed for anthraquinone content. Detailed operating conditions and results are listed in Table 1.

EXAMPLE 2

Same as Example 1 except there is no $H_2O_2$ added into the reactor. Detailed procedure is same as example 1. The results are listed in Table 1.

TABLE I

| | Example 1 | Example 2 |
|---|---|---|
| current density of cathode ($mA/cm^2$) | 1.2 | 1.5 |

TABLE I-continued

| | Example 1 | Example 2 |
|---|---|---|
| current density of anode ($mA/cm^2$) | 6.6 | 8.25 |
| flow rate of electrolyte (ml/min) | 55 | 60 |
| oxygen flow rate (ml/min) | 100 | 200 |
| temperature (°C.) | 25 | 25 |
| electrolyte composition | | |
| $H_2SO_4$ concentration (M) | 10 | 10 |
| $V_2O_5$ concentration (M) | $5.00\times10^{-3}$ | $5.00\times10^{-3}$ |
| anthraquinone concentration (M) | $1.12\times10^{-1}$ | $1.12\times10^{-1}$ |
| 3% $H_2O_2$ flow rate (ml/min) | 10 | 0 |
| electricity used (coulomb) | 300 | 400 |
| theoretical yield of anthraquinone (mole/Farad) | 0.167 | 0.167 |
| actual yield of anthraquinone (mole/Farad) | 0.250 | 0.180 |
| electrolysis efficiency (%) | 150 | 108 |

EXAMPLE 3

Repeat Example 1 except anthracene is substituted by 1,2-methylanthracene. Under this condition, the current efficiency of 2-methyl-9,10-anthraquinone is 0.12 mole/Farad. Operating conditions and results are listed in Table 2.

EXAMPLE 4

Repeat Example 1 except substituting anthracene with 1,2-diethyl-anthracene. Under this condition, the current efficiency of 1,2-diethyl-anthraquinone is approximately 0.1 mole/Farad.

TABLE 2

| | |
|---|---|
| current density of cathode ($mA/cm^2$) | 2.0 |
| current density of anode ($mA/cm^2$) | 11.0 |
| flow rate of electrolyte (ml/min) | 50 |
| oxygen flow rate (ml/min) | 100 |
| temperature (°C.) | 25 |
| electrolyte composition | |
| $H_2SO_4$ concentration (M) | 5 |
| $V_2O_5$ concentration (M) | $3.00\times10^{-3}$ |
| 2-methyl-anthracene concentration (M) | 0.12 |
| 3% $H_2O_2$ flow rate (ml/min) | 8.5 |
| electricity used (coulomb) | 300 |
| theoretical yield of 2-methyl-anthraquinone (mole/Farad) | 0.167 |
| actual yield of 2-methyl-anthraquinone (mole/Farad) | 0.12 |
| electrolysis efficiency (%) | 150 |

TABLE 3

| | |
|---|---|
| current density of cathode ($mA/cm^2$) | 1.5 |
| current density of anode ($mA/cm^2$) | 8.25 |
| flow rate of electrolyte (ml/min) | 50.0 |
| oxygen flow rate (ml/min) | 100 |
| temperature (°C.) | 10 |
| electrolyte composition | |
| $H_2SO_4$ concentration (M) | 0.5 |
| $V_2O_5$ concentration (M) | $5.00\times10^{-3}$ |
| 1,2-methyl-anthracene concentration (M) | 0.01 |
| 3% $H_2O$, flow rate (ml/min) | 8.0 |
| electricity used (coulomb) | 300 |
| theoretical yield of 1,2-diethyl-9,10-anthraquinone (mole/Farad) | 0.167 |
| actual yield of 1,2-diethyl-9,10-anthraquinone (mole/Farad) | 0.1 |

TABLE 3-continued

| electrolysis efficiency (%) | 150 |
|---|---|

Although the present invention and its advantages have been described in detail, those skilled in the art should understand that they can make various changes, substitutions and alterations herein without departing from the spirit and scope of the invention as defined by the appended claims.

What is claimed is:

1. A method for synthesizing a quinone compound from an aromatic compound using a paired redox electrochemical reaction, comprising the steps of:

(a) creating a mixture of a redox mediator having a metal component at a lower valence state of a redox mediator couple and an aromatic compound in an electrolyte solution in a single undivided electrochemical cell having a cathode and an anode;

(b) supplying electricity to said cathode and anode;

(c) bubbling oxygen into said mixture near the bottom of said cathode to form $H_2O_2$; and (d) isolating said quinone compound formed.

2. The method of claim 1 wherein said quinone compound is an anthraquinone.

3. The method of claim 1 wherein said metal component is vanadium, iron or copper.

4. The method of claim 3 wherein said metal component is vanadium and said valence of said vanadium is +4.

5. The method of claim 1 wherein said anode is a flat electrode, and said cathode is a parallel-metal-net cylindrical electrode.

6. The method of claim 1 wherein said aromatic compound is an anthracene or a substituted anthracene.

7. The method of claim 6 wherein said substituted anthracene has a functional group selected from the group consisting of —OH, —$NO_2$, $C_1$–$C_8$ alkyl, and a halogen.

8. A method for synthesizing a quinone compound from an aromatic compound using a paired redox electrochemical reaction, comprising the steps of:

(a) creating a mixture of a redox mediator having a metal component at a lower valence state of a redox mediator couple and an aromatic compound in an electrolyte solution in a single undivided electrochemical cell having a cathode and an anode;

(b) passing electricity to said cathode and anode;

(c) bubbling oxygen into said mixture near the bottom of said cathode and forming $H_2O_2$, whereby a Fenton reagent is formed at said cathode from said $H_2O_2$ and said lower valence state of said metal component;

(d) allowing said aromatic compound to react with said Fenton reagent to form a quinone compound; and (e) isolating said quinone compound formed.

9. The method of claim 8 wherein said aromatic compound is an anthracene or a substituted anthracene.

10. The method of claim 9 wherein said substituted anthracene has a functional group selected from the group consisting of —OH, —$NO_2$, $C_1$–$C_8$ alkyl, and a halogen.

11. The method of claim 8 wherein said quinone compound is an anthraquinone.

12. The method of claim 8 wherein said metal component is selected from the group consisting of vanadium, iron and copper.

13. The method of claim 12 wherein said metal component is vanadium and said valence of said vanadium is +4.

14. The method of claim 8 wherein said electrolyte solution further comprises an organic solution and a supporting electrolyte.

15. The method of claim 14 wherein said organic solution comprises chloroform.

16. The method of claim 14 wherein said supporting electrolyte is selected from the group consisting of a sulfuric acid, perchloric acid, nitric acid, nitrous acid, formic acid, and acetic acid.

17. The method of claim 8 further comprising the step of continuously stirring said mixture during said redox electrochemical reactions.

18. The method of claim 8 wherein said anode is a flat electrode, and said cathode is a parallel-metal-net cylindrical electrode.

19. The method of claim 8 wherein an operating temperature for the electrochemical reaction ranges from about 10° C. to about 55° C.

20. The method of claim 8 wherein an operating pressure for said electrochemical reaction is about 1 atmosphere and the concentration of said supporting electrolyte is from about 0.5 molar to about 10.0 molar.

* * * * *

UNITED STATES PATENT AND TRADEMARK OFFICE

CERTIFICATE OF CORRECTION

PATENT NO. : 5,466,346
DATED : Novemer 14, 1995
INVENTOR(S) : Chou et al.

It is certified that error appears in the above-indentified patent and that said Letters Patent is hereby corrected as shown below:

Col. 1, line 29, following "$Ce^{4+}/Ce^{3+}$", insert -- , --.

Col. 3, line 15, delete "$V^{5++}e^{-}$" and insert -- $V^{5+}+e^{-}$ --.

Col. 3, line 19, delete "$2H^{++}O$" and insert -- $2H^{+}+O$ --.

Col. 3, line 22, delete "$V^{5++}OH^{-}$" and insert -- $V^{5+}+OH^{-}$ --.

Col. 4, line 29, following "a flat anode surface", insert -- (11) --.

Col. 4, line 30, following "sponge-like surface", insert -- (12) --.

Col. 5, line 23, following "line", insert -- (41) --.

Col. 6, in Table I, following the line "anthraquinone concentration (M) $1.12 \times 10^{-1}$ $1.12 \times 10^{-1}$", insert a blank line.

Col. 6, line 23, delete "1,2-methylanthracene" and insert -- 2-methyl-anthracene --.

Col. 6, in Table 2, following the line "(M)", insert a blank line.

UNITED STATES PATENT AND TRADEMARK OFFICE

CERTIFICATE OF CORRECTION

PATENT NO. : 5,466,346

DATED : November 14, 1995

INVENTOR(S) : Chou, et. al.

It is certified that error appears in the above-indentified patent and that said Letters Patent is hereby corrected as shown below:

Col. 6, Table 3, collowing the line "1, 2-methyl -anthracene concentration (M) 0.01", insert a blank line.

Signed and Sealed this

Twelfth Day of March, 1996

Bruce Lehman

*Attest:*

BRUCE LEHMAN

*Attesting Officer*

*Commissioner of Patents and Trademarks*